United States Patent [19]

Gustafsson

[11] 4,369,823

[45] Jan. 25, 1983

[54] BARKING DRUM AND METHOD

[75] Inventor: Sten-Ake Gustafsson, Edsvalla, Sweden

[73] Assignee: Aktiebolaget Karkstads Mekaniska Werkstad, Karlstad, Sweden

[21] Appl. No.: 242,672

[22] Filed: Mar. 11, 1981

[30] Foreign Application Priority Data

Mar. 17, 1980 [SE] Sweden ..... 8002052

[51] Int. Cl.[3] ..... B27L 1/00

[52] U.S. Cl. ..... 144/340; 144/2 Z; 144/208 B; 144/343; 241/183

[58] Field of Search ..... 241/152 R, 183, 76; 144/208 R, 208 B, 340, 343, 2 Z

[56] References Cited

U.S. PATENT DOCUMENTS

| | | | |
|---|---|---|---|
| 1,904,937 | 4/1933 | Strindlund | 144/208 B |
| 3,158,255 | 11/1964 | Schnyder | 144/208 B |
| 3,286,747 | 11/1966 | Delcellier | 144/208 B |
| 3,896,863 | 4/1975 | Smiltneek | 144/311 |
| 3,948,300 | 4/1976 | Young | 144/208 B |
| 4,032,075 | 6/1977 | Tyer, Sr. | 241/183 |
| 4,243,182 | 1/1981 | Dugger, Jr. | 241/183 |

*Primary Examiner*—W. D. Bray

*Attorney, Agent, or Firm*—Bell, Seltzer, Park & Gibson

[57] ABSTRACT

In order to effect removal of both limbs and bark from wood, such as trimmings or trees removed in thinning, with satisfactory results in a barking drum, the drum proper comprises a cylindrical pretreatment section of large diameter, a tapering transition section and a cylindrical final treatment section of smaller diameter. In the pretreatment section, which has a larger number of log lifters, an intensive treatment of the bundle takes place, so that the stems of the trees are exposed while branches and twigs are crushed. In the transition section, which has only half the number of log lifters, the tumbling motion of the wood subsides and a change-over takes place to parallel barking, which is concluded in the final treatment section, where the number of log lifters is again increased, suitably up to the original number. The pretreatment section is preferably preceded by an infeed section with infeed means arranged on the inside for quick feeding-in of the bundle of trees into the pretreatment section. The infeed means can consist of helically extending pusher vanes.

10 Claims, 7 Drawing Figures

BARKING DRUM AND METHOD

FIELD OF THE INVENTION

The present invention relates to improvements in a barking drum of the type which comprises a rotatable drum, open at both ends, with log lifters arranged on the inside of the drum for engaging and lifting the logs during rotation of the drum to remove bark from the logs. This invention also relates to an improved method for removing limbs and bark from wood with the use of a rotary barking drum.

BACKGROUND OF THE INVENTION AND PRIOR ART

Barking drums of the general type noted above are known, as shown for example in Canadian Patent 813,131. Pulpwood logs (roundwood) introduced into the barking drum are tumbled around during simultaneous travel in the length direction of the drum, during which they are freed from bark by friction against each other and, to a certain extent, against the drum wall. In the embodiment shown in the above-noted Canadian patent, the drum itself is cylindrical, which is most common nowadays, although many other shapes have been suggested both prior to said patent and subsequently. In Swedish Pat. No. 27,096, for example, the drum is of slightly conical shape, such that it is somewhat larger at the discharge end than at the inlet end, whereby the wood can be conveyed through the drum automatically without the need for the drum to be inclined. In contrast to this arrangement, FIG. 6 of U.S. Pat. No. 1,300,536 shows how a cylindrical drum has been provided with a series of retarding devices in the form of transverse partitions arranged at a distance from each other along the axis of the drum and having central openings of gradually decreasing diameters towards the discharge end of the drum to permit the wood to pass therethrough.

Further, it has been suggested in U.S. Pat. No. 1,700,390 that a cylindrical drum be provided with a special infeed section consisting of a truncated cone, smooth on the inside and with a small inlet diameter and a large discharge diameter. Full scale trials have proven that this suggestion is not feasible. Another proposal that is intended to increase the degree of filling of the drum is shown in FIGS. 3 and 4 of Swedish Pat. No. 75,658. Here the drum is divided up into separately supported and separately driven sections of different diameters. The sections nearest the drum ends have larger diameters than the sections nearest the middle of the drum, and these sections of larger diameter are arranged with their axes of rotation at the side of and above the axes of rotation of the middle sections in such a way that the degree of filling of the middle sections can be increased.

A barking drum is described in Soviet Union Pat. No. 479,624 in which the shell of the drum is constructed as a truncated cone with log lifters attached to the inside. The discharge half of the drum is narrower and is provided with bark discharge slots, while the inlet half is wider, has no bark discharge slots, and is fitted with an annular flange extending inwards at the inlet end, whereby a quantity of water can be retained in the inlet half for soaking the wood. A barking drum constructed in this way is stated to be of simplified design and to have an increased capacity.

The use of different numbers of log lifters in separate sections of the drum is also known in a barking drum, as disclosed for example in German Auslegeschrift No. 1 202 470. In this a cylindrical barking drum is described with bark discharge slots at the discharge end only. The inside of the drum is divided axially into chambers by means of annular partitions, and the inside diameter of the annular partitions increases from the inlet end to its discharge end. The drum consists of two halves, an inlet half and a discharge half, which are separately supported in bearings and separately driven, and in the discharge half there is a larger number of log lifters than in the inlet half, for reasons not stated.

In all cases, the known barking drums are intended and designed for barking pulpwood logs, specifically, logs which have previously been removed of limbs in preparation for barking, and are not intended for processing logs having limbs, such as the trimmings from the pulpwood logs or smaller trees removed in thinning.

SUMMARY OF THE INVENTION

The object of the present invention is to provide a barking drum that is suitable not only for barking pulpwood logs, but which is also suited for both limbing and barking trees, particularly in the form of bundles of trimmings, such as limbs, or smaller trees removed in thinning.

This object is achieved according to the invention with the use of a barking drum of the general type mentioned in the introduction, but wherein the drum comprises a pretreatment section with a first plurality of log lifters, a tapering transition section with a second smaller plurality of log lifters, and a final treatment section of smaller diameter with again a larger plurality of log lifters.

In the pretreatment section, which has a relatively large diameter, suitably of the order of magnitude of about 5 meters, a relatively rapid breaking-off and breaking-up of twigs and any small branches takes place during what can be most closely characterized as tumbling barking, whereby the whole tree bundle is tumbled about and divided up into separate logs and detached material, i.e. needles or leaves, crushed limbs and some bark. In the tapering transition section with fewer log lifters, the motion of the logs subsides and changes from tumbling to the movement pattern characterized as parallel barking, which provides a more gentle treatment of the logs and produces less wood losses. The main part of the bark is removed in the final treatment section that follows and which has a reduced diameter, suitably of the order of size of 3.5 to 4 meters, and again an increased number of log lifters in order to produce an intensive parallel barking.

It is desirable that the number of log lifters in the pretreatment section and the final treatment section be approximately the same, and that the transition section have approximately half the number of log lifters. For example, the pretreatment and final treatment sections can each contain sixteen log lifters, while the transition section has eight log lifters.

The drum preferably comprises an infeed section arranged upstream of the pretreatment section and provided on the inside with infeed means for quickly feeding the wood into the pretreatment section. For this it is desirable that the infeed means comprise a drum with at least one substantially flat but arcuate pusher vane formed of a plate attached to the inside of the infeed section drum and extending generally helically along the interior of the drum. The pusher vane is adapted to engage the wood received in the infeed section and to push it quickly into the pretreatment section. An infeed section of this kind ensures that the bundle of pulpwood logs or whole trees is essentially immediately fed into the pretreatment section, so that the infeed section is quickly clear to receive the next bundle, through which a high degree of filling is obtained and at the same time the wood last introduced produces a positive forward movement through the drum of the wood fed into the drum previously.

The invention will now be described in more detail with reference to the accompanying drawings.

DESCRIPTION OF ILLUSTRATED EMBODIMENT

Figure 4:
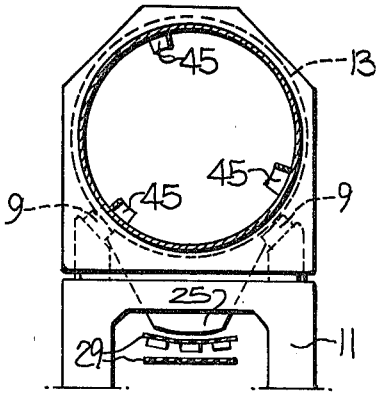

Similar to previously known barking drums, the braking drum shown in the drawing comprises a horizontal rotatable drum 1 open at both ends and manufactured of heavy gauge plate. The drum 1 consists of an inlet half 3 and a discharge half 5, which are separated axially by an annular gap 7 with a width of one or a few centimeters. Each of the drum halves 3 and 5 is separately mounted in two pairs of hydrostatic shoe bearings 9, one pair of which are shown in FIG. 4. The bearings 9 are supported on a base 11 and act on a support ring 13 attached to the drum 1. For each drum half, one of the four bearings is a hydrostatic shoe bearing with axial location on the support ring 13. The hydrostatic shoe bearings 9 are of known construction, and suitably of the type shown in Ball Bearing Journal No. 173 (SKF 1973). It is desirable that the drum 1 slopes slightly towards the discharge end, for example the axis of rotation of the drum can form an angle of between approximately 1.0° and approximately 1.5° with the horizontal plane. Both the drum halves 3 and 5 are separately driven from a direct-current motor 15 each, through a reduction gear 17 (FIG. 5) which rotates a pin gear ring 19 fixed to the respective drum half.

Figure 1:
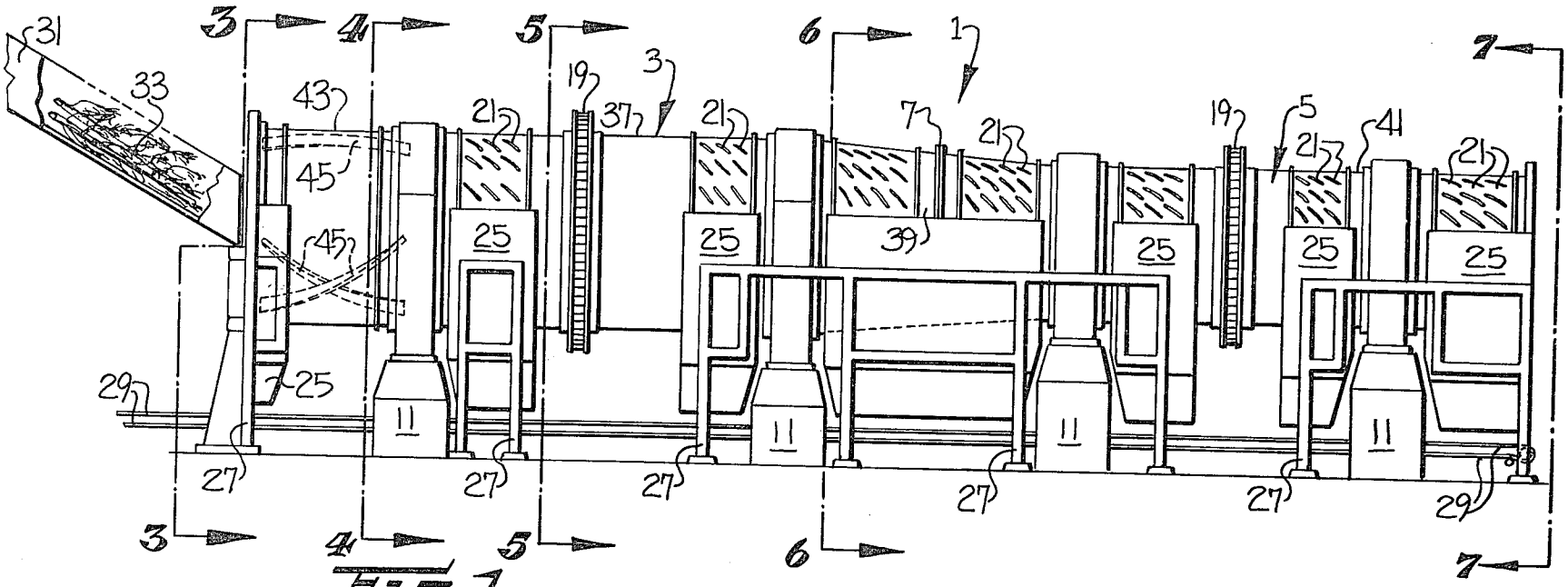
FIG. 1 is a side elevation and FIG. 2 is a plan view of a barking drum constructed in accordance with a preferred embodiment of the invention.
Figure 2:
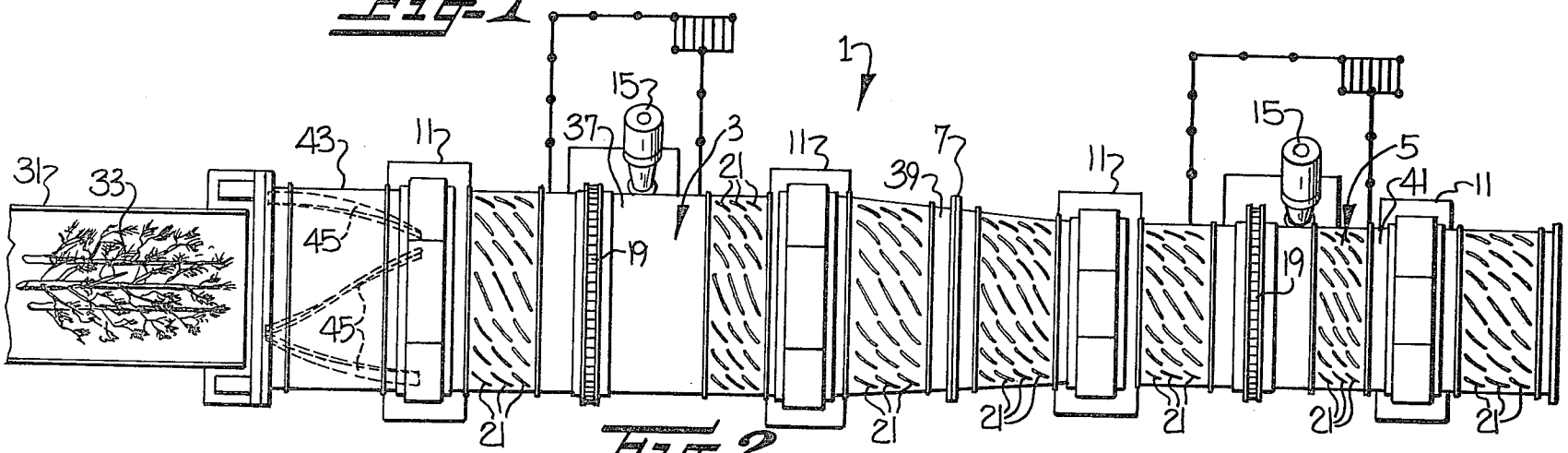
Figure 3:
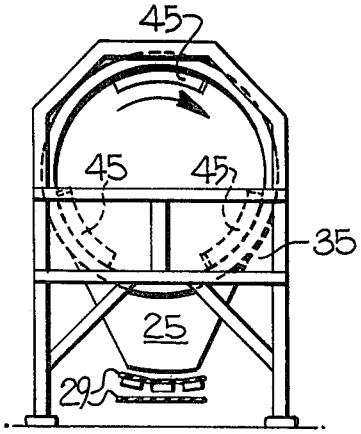
FIGS. 3 and 7 are end views of the drum from the lines 3—3 and 7—7, respectively, in FIG. 1, and FIGS. 4, 5 and 6 are cross sections along the lines 4—4, 5—5 and 6—6, respectively, in FIG. 1.

Further, the barking drum 1 is provided with bark discharge slots 21 at a plurality of positions along its length, these being located between longitudinal log lifters 23 (FIGS. 5, 6 and 7) arranged on the inside of the drum 1, and made oblique in relation to the log lifters 23 and the axis of rotation of the drum in order to provide increased strength and improved discharge of bark compared with bark discharge slots extending purely axially. Below each group of bark discharge slots 21 there is a collecting hopper 25 supported by a framework 27. The hoppers 25 discharge onto a suitable conveyor, e.g. a belt conveyor 29, for removal of the bark. In addition, there is an inclined chute 31 for supplying of forest raw material 33 to the inlet end of the barking drum. The forest raw material 33, as shown in FIGS. 1 and 2, is in the form of a bundle of limbs and other trimmings removed from pulpwood logs. The bottom of the chute 31 at the inlet end is located slightly below, e.g. approximately 0.5 meter below, the axis of rotation of the drum 1, and the inlet opening below the chute 31 is closed by a transverse plate 35 to ensure that the forest raw material supplied cannot drop out of the inlet end of the drum. If required, a conventional gate, not shown, e.g. a sliding gate, covering a lower part of the drum cross section can be arranged at the discharge end of the drum 1 in order to regulate the holding time in the drum and thus the discharge of barked wood.

According to the invention, the drum 1 comprises a pretreatment section 37 of large diameter and with a first plurality of log lifters 23', a tapering transition section 39 with a second, smaller plurality of log lifters 23", and a final treatment section 41 of smaller diameter and with a third, again larger plurality of log lifters 23'''. The first and third pluralities are preferably approximately equal and the second plurality approximately half this number.

Figure 5:
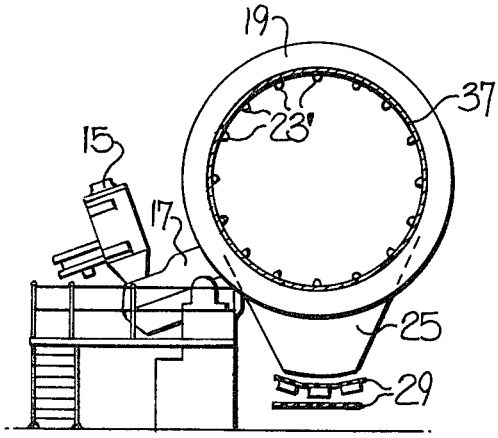
Figure 6:
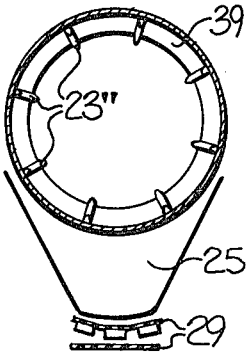
Figure 7:
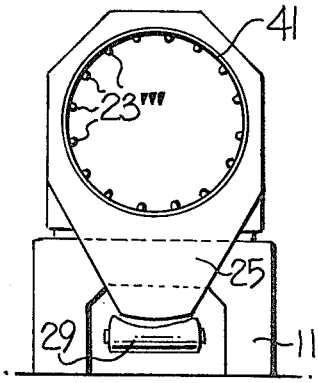

In the embodiment shown, the pretreatment section 37 has a constant diameter of 5 meters and a length of 9.8 meters and, as shown in FIG. 5, it has sixteen log lifters 23' equally spaced around the inside circumference of the drum, extending parallel to the axis of rotation of the drum and with a cross section substantially L-shaped to semi-circular. The transition section 39 tapers from 5 meters to 3.8 meters in diameter over a length of approximately 7.5 meters, 4.1 meters of which pertains to the inlet half 3 of the drum and 3.4 meters to the discharge half 5. FIG. 6 shows that the number of log lifters 23", which are of unchanged configuration, has been reduced to eight in the transition section. The final treatment section 41 has a constant diameter of 3.8 meters and a length of 11.6 meters, and the number of log lifters of unchanged configuration is shown in FIG. 7 to have been increased to sixteen again.

The drum 1 preferably comprises in addition an infeed section 43 arranged upstream of the pretreatment section 37 and the inside of which is provided with infeed means 45 for quick feeding-in of the forest raw material 33 into the pretreatment section 37. In the embodiment shown, the infeed section has a diameter of 5 meters and a length of 4.1 meters, and the infeed means 45 comprises three substantially radially and helically extending, essentially flat but arcuate pusher vanes 45 attached to the inside of the infeed section 43 and displaced 120° from each other around the circumference, the forest raw material 33 sliding along said pusher vanes into the pretreatment section 37. The inclination of the pusher vanes 45 relative to the axis of rotation of the drum can suitably be 15° to 25°, and the pusher vanes can have a radial height of 0.5 meter, for example.

A braking drum designed in the way described above is particularly suitable for limbing and barking bundles of trees, preferably wood exhausted by thinning. Each bundle will be quickly fed into the pretreatment section 37 by the pusher vanes 45 of the infeed section 43, so that in principle the infeed section is continually ready to receive a new bundle. In the pretreatment section 37, which is of large diameter and has a relatively large number of log lifters 23', a forceful treatment of the bundle will take place during what can most closely be characterized as tumbling barking. Twigs and branches are broken off from the stems and crushed at least partially, and the crushed material is separated off, together with needles or leaves, through the bark discharge slots 21 of the pretreatment section 37. As soon as new bundles are introduced from the infeed section 43, the delimbed stems will push each other into the transition section 39, and the whole process takes place so quickly that the average holding time for a stem in the pretreatment section 37 is of the order of magnitude of two minutes. In the tapering transition section 39 with a reduced number of log lifters 23'', the motion of the logs subsides from tumbling barking to parallel barking, which is gentler and produces less wood losses. A major part of the bark begins to come loose, and any remaining branches and twigs are crushed and separated off together with the detached bark through the bark discharge slots 21 of the transition section 39. Final removal of bark then takes place as parallel barking in the final treatment section 41, which has a reduced diameter but again an increased number of log lifters 23'''.

Although the invention has been described above in conjunction with limbing and barking of bundles of trees, those skilled in the art will recognize that the barking drum according to the invention is also particularly suitable for drum barking of conventional pulpwood logs.

In the drawings and specification, there has been set forth a preferred embodiment of the invention, and although specific terms are employed, they are used in a generic and descriptive sense only and not for purposes of limitation.

That which is claimed is:

1. A barking drum particularly adapted for the removal of limbs and bark from wood, such as trimmings or trees removed in thinning, said barking drum comprising a rotatable drum which is open at opposite ends, said drum including a pretreatment section, a first plurality of log lifters carried by the interior of the pretreatment section and adapted for engaging the wood received in the pretreatment section, a tapering transition section arranged for receiving the wood from said pretreatment section, a plurality of log lifters of lesser number than in said pretreatment section carried by the interior of said transition section, a final treatment section arranged for receiving the wood from said transition section and a plurality of log lifters greater in number than in said transition section carried by the interior of said final treatment section.

2. A barking drum according to claim 1 wherein the log lifters in said pretreatment section are approximately equal in number to the log lifters in said final treatment section, and the log lifters in said transition section are approximately half the number in said pretreatment section.

3. A barking drum as set forth in claims 1 or 2 additionally comprising an infeed section arranged upstream of said pretreatment section for receiving the wood and feeding the same to said pretreatment section, said infeed section including means located internally thereof for engaging the wood and quickly feeding the same into the pretreatment section.

4. A barking drum according to claim 3 wherein said means for engaging the wood comprises at least one pusher vane carried by the interior of the infeed section and extending generally helically therealong.

5. A barking drum particularly adapted for the removal of limbs and bark from wood, such as trimmings or trees removed in thinning, said barking drum comprising a generally horizontally oriented rotatable drum which is open at opposite ends, said drum including a series of bark discharge slots at spaced locations about the circumference of the drum and at a plurality of locations along the length thereof, and said drum including a cylindrical pretreatment section adapted for receiving a bundle of the wood, a first plurality of longitudinally extending log lifters carried by the interior of said pretreatment section and adapted for engaging the bundle of wood received in the pretreatment section and imparting a tumbling motion to the wood material so as to separate the bundle while rapidly removing and breaking up limbs and twigs, a conically tapering transition section arranged for receiving the wood from said pretreatment section, a plurality of longitudinally extending log lifters of lesser number than in said pretreatment section carried by the interior of said transition section and adapted for engaging the wood received in the transition section during rotation of the drum and for changing the motion of the wood from a tumbling motion to a parallel motion for effecting parallel barking whereby a more gentle treatment of the wood is achieved producing less wood losses, a cylindrical final treatment section of smaller diameter than said pretreatment section and arranged for receiving the wood from said transition section, and a plurality of longitudinally extending log lifters greater in number than in said transition section carried by the interior of said final treatment section and adapted for engaging the wood received in the final treatment section during rotation of the drum to effect parallel barking of the wood.

6. A method for removing limbs and bark from wood, such as trimmings or trees removed in thinning, in a rotary barking drum, said method comprising feeding a bundle of the wood into a pretreatment section of the barking drum having a plurality of log lifters while rotating the pretreatment section and engaging the wood therein with the log lifters so as to impart tumbling of the wood in the pretreatment section to separate the bundle into individual logs while rapidly removing and breaking up limbs and twigs, advancing the wood from the pretreatment section to a transition section having a plurality of log lifters while rotating the transition section and engaging the wood therein with the log lifters so as to change the motion of the wood from a tumbling motion to a parallel motion for effecting parallel barking whereby a more gentle treatment of the wood is achieved producing less wood losses, advancing the wood from the transition section to a final treatment section having a plurality of log lifters while rotating the final treatment section and engaging the wood therein with the log lifters so as to continue to effect parallel barking of the wood, and discharging the thus delimbed and debarked wood from the final treatment section.

7. A method according to claim 6 including the further step of directing the bundle of wood initially into an infeed section located immediately upstream of the pretreatment section, and rotating the infeed section while engaging the bundle of wood therein with at least one pusher member so as to rapidly feed the bundle of wood into the pretreatment section.

8. A method as set forth in claim 7 including the step of repeatedly feeding successive bundles of wood into the infeed section and utilizing each newly fed bundle of wood introduced to the infeed section for pushing the previous bundle of wood from the pretreatment section into the transition section.

9. A method as set forth in claim 6 wherein said step of engaging the wood in the transition section with a plurality of log lifters comprises engaging the wood with a lesser number of log lifters than in the pretreatment section.

10. A method as set forth in claim 6 or 9 wherein said step of engaging the wood in the final treatment section with a plurality of log lifters comprises engaging the wood with a greater number of log lifters than in the transition section.

* * * * *